US005578897A

United States Patent [19]

Nomura et al.

[11] Patent Number: 5,578,897

[45] Date of Patent: Nov. 26, 1996

[54] MULTI-ELECTRON SOURCE, IMAGE-FORMING DEVICE USING MULTI-ELECTRON SOURCE, AND METHODS FOR PREPARING THEM

[75] Inventors: Ichiro Nomura, Atsugi; Yoshikazu Banno, Ebina; Tetsuya Kaneko, Yokohama; Toshihiko Takeda, Atsugi; Kumi Iwai, Isehara, all of Japan

[73] Assignee: Canon Kabushiki Kaisha, Tokyo, Japan

[21] Appl. No.: 404,958

[22] Filed: Mar. 16, 1995

Related U.S. Application Data

[62] Division of Ser. No. 10,302, Jan. 28, 1993, Pat. No. 5,470, 265.

[30] Foreign Application Priority Data

May 23, 1990 [JP] Japan ..... 2-131346

[51] Int. Cl.[6] ..... H01J 1/00

[52] U.S. Cl. ..... 313/310

[58] Field of Search ..... 313/310, 309

[56] References Cited

U.S. PATENT DOCUMENTS

| | | | |
|---|---|---|---|
| 3,735,186 | 5/1973 | Klopfer et al. | 313/346 R |
| 5,023,110 | 6/1991 | Nomura et al. | 427/545 |
| 5,066,883 | 11/1991 | Yoshioka et al. | 313/309 |
| 5,155,416 | 10/1992 | Suzuki et al. | 315/366 |
| 5,304,815 | 4/1994 | Suzuki et al. | 257/10 |

*Primary Examiner*—Alvin E. Oberley
*Assistant Examiner*—Lawrence O. Richardson
*Attorney, Agent, or Firm*—Fitzpatrick, Cella, Harper & Scinto

[57] ABSTRACT

A multi-electron source has a plurality of electron emitting portions arranged on a substrate. Each electron emitting portion comprises a conductive film containing a crack with an average width of 0.05 μm to 1 μm. The electron emitting portions are prepared by subjecting conductive films, preferably of fine particles, to a pulse voltage application treatment.

14 Claims, 6 Drawing Sheets

MULTI-ELECTRON SOURCE, IMAGE-FORMING DEVICE USING MULTI-ELECTRON SOURCE, AND METHODS FOR PREPARING THEM

This application is a continuation division of application Ser. No. 08/010,302 filed Jan. 28, 1993, now U.S. Pat. No. 5,470,265.

BACKGROUND OF THE INVENTION

1. Field of the Invention

The present invention relates to a multi-electron source, an image-forming device using the multi-electron source and methods for preparing them.

2. Related Background Art

As an element of a simple structure for emitting electrons, for example, a cold cathode element is heretofore known which has been reported by M. I. Elinson et al. [Radio Eng. Electron. Phys., Vol. 10, pp. 1290–1296 (1965)].

This kind of element utilizes the phenomenon that electrons are emitted by allowing current to flow in parallel to the surface of a thin film having a small area formed on a substrate, and it is usually called a surface conduction type electron emitting element.

As examples of this surface conduction type electron emitting element, there have been reported an element using an $SnO_2$(Sb) thin film developed by Elinson et al. as mentioned above, an element using an Au thin film [G. Dittmer, "Thin Solid Films", Vol. 9, pp. 317 (1972)], an element using an ITO thin film [M. Hartwell and C. G. Fonstad, IEEETrans. ED Conf., pp. 519 (1975)], and an element using a carbon thin film [Hisashi Araki et al., "Shinku (Vacuum)", Vol. 26, No. 1, pp. 22 (1983)].

FIG. 1 shows the constitution of a typical one of these surface conduction type electron emitting elements. In this drawing, reference numerals 1 and 2 are electrodes for giving an electrical connection, numeral 3 is a thin film made of an electron emitting material, 4 is a substrate, and 5 is an electron emitting portion (crack portion), and L is a width of the electron emitting portion.

Heretofore, in the surface conduction type electron emitting element, the electron emitting portion is formed by a resistive heating treatment called "forming" prior to carrying out electron emission. That is, voltage is applied between the electrodes 1 and 2 to electrify the thin film 3, so that Joule heat is generated and this heat locally breaks, deforms or modifies the thin film 3 to form the electron emitting portion 5 which is in an electrically highly resistant state, whereby an electron emitting function is obtained.

The above-mentioned "electrically highly resistant state" means a discontinuous state of the thin film 3 in which a crack having a width of 1.0 μm to 5 μm is partially formed and it has the so-called island structure. This thin film is physically discontinuous but electrically continuous.

In the case of the conventional surface conduction type electron emitting element, voltage is applied to the above-mentioned highly resistant discontinuous film through the electrodes 1 and 2 to electrify the surface of the element, whereby electrons can be emitted from the fine particles.

However, the electron emitting element prepared by the forming treatment using the conventional resistive heating technique has the following problems.

1) It is impossible to design the island structure of the electron emitting portion, and therefore the improvement of the element is difficult and the quality is also liable to be uneven among the elements.

2) Since a large Joule heat is generated in the forming step, the substrate tends to be broken, and for this reason, multiplication is difficult.

3) The material of the island is limited to gold, silver, $SnO_2$, ITO and the like, and so a material having a small work function cannot be used. Thus, a large emitting current cannot be obtained.

In view of the above-mentioned points, the surface conduction type electron emitting element has not been positively utilized on an industrial scale, though it has the advantage that the element structure is simple.

The present inventors have intensively investigated to solve the above-mentioned problems, and as a result, in U.S. Pat. No. 5023110 (Japanese Patent Application Laid-open No. 2-56822), they have suggested a novel surface conduction type electron emitting element in which a fine particle film is disposed between electrodes and an electron emitting portion is formed by a conduction treatment (voltage applying treatment). A constitutional view of this novel electron emitting element is shown in FIG. 2.

In this drawing, numerals 11 and 12 are electrodes, 13 is a fine particle film, 14 is an electron emitting portion (crack portion), 15 is a substrate, and L is a width of the electron emitting portion.

Features of this electron emitting element are as follows:

1) Since the electron emitting portion 14 can be formed by allowing very small current to flow in the fine particle film 13, the element which is free from degradation can be prepared. In addition, the shape of the electrodes can be optionally designed.

2) The fine particles constituting the fine particle film are a constitutional material for the electron emission, and therefore, the selection of the fine particle material and the design of the fine particle shape are possible, which means that electron emission properties can be designed.

3) Materials of the substrate 15 end the electrodes which are constitutional members of the element can be selected from a wide range.

Examples of practical articles of the electron emitting element described above include various electron beam application equipments such as displays, fluorescent lamps, ion generators, etc. In recent years, a device using a plate electron source in which such elements are multiply arranged, for example, a flat CRT shown in Japanese Patent Application Laid-open No. 61-221783, has been energetically researched end developed.

Now, in order to prepare a plate electron source in which surface conduction type electron emitting elements are multiply arranged, it is usually necessary to take such an element arrangement as shown in FIG. 3.

In this drawing, reference numeral 21 is a substrate, numeral 24 is an electron emitting element comprising element electrodes 22 end an electron emitting portion 23, 25 is a wiring electrode, 26 is a power source for forming, end 27 is a connection wire for electrically connecting the wiring electrode 25 to the power source 26. In this drawing, the electron emitting portion 23 corresponds to the electron emitting portion 5 in FIG. 1 or the electron emitting portion 14 and the fine particle film 13 in FIG. 2.

For the preparation of the plate electron source using such surface conduction type electron emitting elements, it is necessary to arrange a plurality of the electron emitting elements 24 between the wiring electrodes 25 as in FIG. 3 and to further carry out an overall forming treatment to the plurality of electron emitting element.

However, in the case that a plurality of electron emitting portions as in FIG. 3 are formed at a time by using the conventional forming treatment in which a DC voltage is very slowly applied (e.g., at a voltage rise rate of 1 volt/minute) in a vacuum, the following drawbacks are present.

(1) In the overall forming treatment of a plurality of fine particle films as shown in FIG. 2, the temperature rise at the time of the forming is significantly, which leads to the degradation of properties and renders characteristics of the respective elements ununiformed.

(2) In the overall forming treatment of a plurality of conductive thin films as shown in FIG. 1, a still larger amount of heat is generated at the time of the forming, and therefore the problem of the breakage of the substrate and the element electrodes are raised in addition to the problem in the above-mentioned paragraph (1).

(3) Additionally, in order to uniformly emit a large number of electron beams from the plate electron source, it is necessary to arrange the electron emitting elements 24 in the state of high density, and in this case, the drawbacks in the preceding paragraphs (1) and (2) are emphasized.

Next, reference will be made to an image"forming device shown in FIG. 8 in which a plurality of the above-mentioned electron emitting elements are arranged. In FIG. 8, numeral 21 is an insulating substrate (a rear plate), 25 and 26 are wiring electrodes, 31 is a modulation means (a grid electrode), 32 is an electron passage orifice, 41 is a rear plate, 42 is an element wire, 43 is a grid electrode wire, 44 is a transparent electrode, 45 is a fluorescent member, 46 is a glass plate, 47 is a face plate consisting of the members 44, 45 and 46, and 48 is an EV terminal. The interior of such an image-forming device is kept under a vacuum state by the rear plate 41, the face plate 47 and the like, as shown in the same drawing.

In the image-forming device (flat CRT) described above, voltage based on an information signal is applied to the element wires 42 and grid wires 43 (the element wires 42 are connected to the wiring electrodes 25 and 26, and the grid wires 43 are connected to the grid electrodes 31), and electrons emitted from the electron emitting elements 24 are ON/OFF-controlled by the grid electrodes 31 to allow the electrons to collide against the fluorescent member 45, whereby a predetermined image is displayed.

In such an image-forming device, the above-mentioned drawbacks of the multi-electron source which take place in the forming step for forming a plurality of electron emitting portions give rise to fatal problems such as defective display and uneven display.

SUMMARY OF THE INVENTION

That is, an object Of the present invention is to provide a method for preparing a multi-electron source which can solve the above-mentioned problems.

Another object of the present invention is to provide a multi-electron source, an electron emitting device and an image-forming device which can solve the above-mentioned problems.

A first aspect of the present invention is directed to a method for preparing a multi-electron source which comprises subjecting conductive films arranged between electrodes to a conduction treatment to form a plurality of electron emitting portions at a time, said conduction treatment being carried out by applying a pulse voltage between said electrodes.

In particular, in the case that conductive fine particles are dispersed between the element electrodes of the surface conduction type electron emitting elements, the first aspect of the present invention is directed to a method for preparing a multi-electron source which comprises applying 4 to 20 volts, preferably 4 to 10 volts, as a pulse voltage for a conduction treatment to form electron emitting portions, or alternatively applying 4 to 10 volts as a pulse voltage for the conduction treatment in a first step, and further applying 10 volts or more in a second step to form the electron emitting portions.

A second aspect of the present invention is directed to a multi-electron source having a plurality of electron emitting portions arranged on a substrate, each of said electron emitting portions comprising a conductive film containing a crack with an average width of 0.05 μm to 1.0 μm.

A third aspect of the present invention is directed to a multi-electron source having a plurality of electron emitting portions arranged on a substrate, said plurality of electron emitting portions comprising conductive films containing cracks with average widths of which deviation is in the range of 0 to 100%.

A fourth aspect of the present invention is directed to an electron emitting device and an image forming device in which the emitting current scatter among all the electron emitting elements is 15% or less.

A fifth aspect of the present invention is directed to an image forming device in which the luminance scatter of the image forming member is 15% or less.

That is, according to the present invention, the voltage to be applied at the time of forming is in the state of a pulse wave-form, whereby heat generated at the forming can be reduced to overcome the above-mentioned drawbacks. Furthermore, the present inventors have found that among values of the pulse voltage to be applied at the time of the forming, a suitable value is present, whereby the above-mentioned problems can be solved.

Moreover, according to the present invention, the average widths of the electron emitting portions (or average crack widths) of all the electron emitting elements are in the range of 0.05 μm to 1.0 μm, more suitably 0.1 μm to 0.5 μm, or the deviation of the average widths is in the range of 0% to 100%, more suitably 0% to 50%, whereby the current scatter among all the electron emitting elements is 15% or less and the luminance scatter of the fluorescent member is 15% or less, with the result that the above-mentioned problems can be solved.

DESCRIPTION OF THE PREFERRED EMBODIMENTS

Next, detailed reference will be made to constitutional requirements regarding a multi-electron source and an image forming device of the present invention and a method for preparing them.

Figure 3:
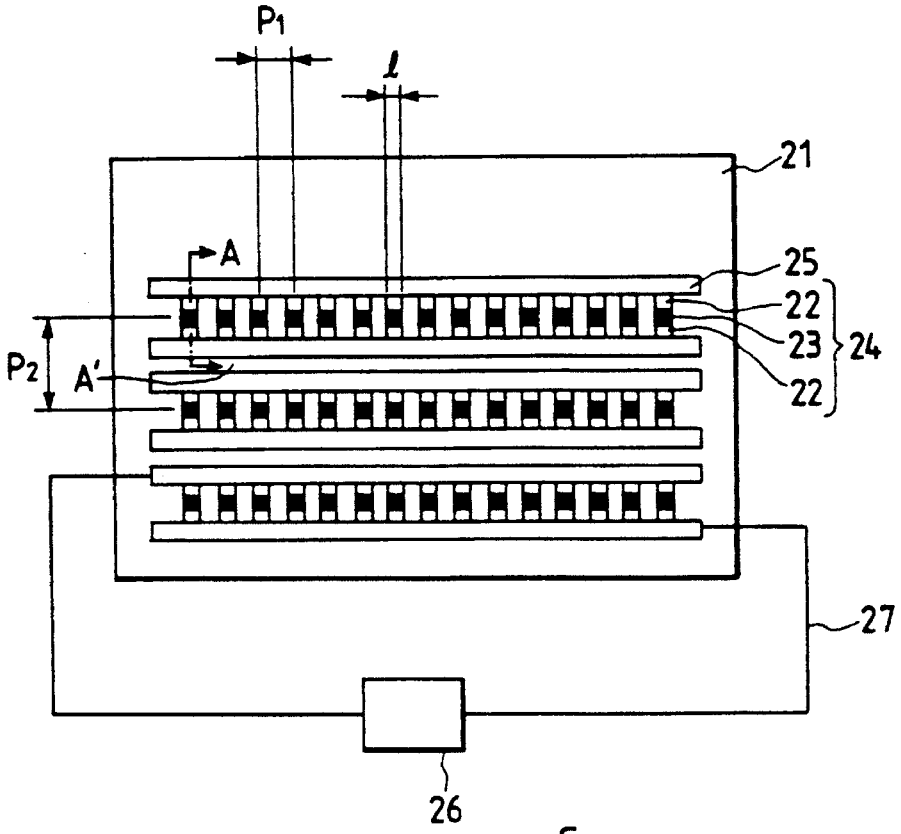
FIG. 3 is a constitutional view of a multi-electron source regarding the first and second embodiments of the present invention.
Figure 4A:
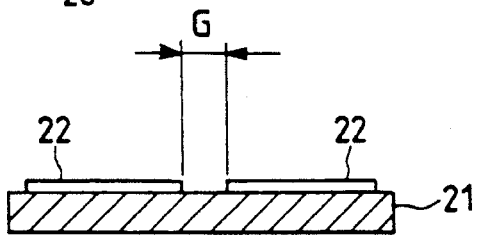
FIGS. 4A to 4C are views illustrating a preparation procedure of the multi-electron source regarding the first embodiment of the present invention.
Figure 4B:
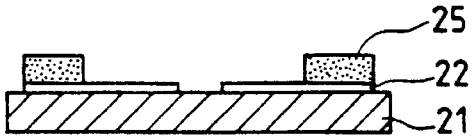
Figure 4C:
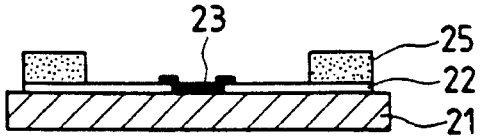

FIGS. 4A to 4C show a section cut along the line A–A' in FIG. 3 and denote a method for preparing the multi-electron source of the present invention. (1) In the first place, as shown in FIG. 4A, a glass substrate 21 is sufficiently washed, and element electrodes 22 are then formed thereon by a vapor deposition technique and a photolithography technique which are conventionally used. Here, as a material for the substrate, an insulating substance such as alumina ceramics may be used in addition to the glass. Furthermore, as a suitable material for the element electrodes 22, there can be used metallic materials such as Ni and stainless steel as well as other conductive materials, for example, an oxide conductor such as ITO. The practical materials for the element electrodes 22 are suitably high-melting metallic materials such as Ni, stainless steel and nichrome. In addition, the space G between the pair of electrodes 22 is suitably from 0.1 μm to 5 μm. The thickness of the element electrodes 22 is suitably from 0.05 μm to 1.0 μm, which is not restrictive. (2) Next, as shown in FIG. 4B, wiring electrodes 25 are formed by a vapor deposition technique and an etching technique. As a material for the wiring electrodes 25, a wide range of materials can be used, so long as they are formed so that electrical resistance may be sufficiently low. (3) Next, as shown in FIG. 4C, a fine particle film 23 is formed between the element electrodes. The particle diameter of the fine particles is suitably from 10 Å to 1 μm, practically about 100 Å. Materials for the fine particles are metallic materials such as Pd, Ag and Au as well as oxide materials such as PdO, $SnO_2$ and $In_2O_3$, but they are not restrictive, so long as they are conductive fine particles. As techniques for forming the fine particle film, there are (a) a gas deposition method and (b) a method which comprises dispersing-and applying an organic metal, and then carrying out a heat treatment. The thickness of the fine particle film depends upon the material and size of the fine particles, but it is suitably from 10 Å to 500 Å, which is not restrictive. The sheet resistance of the fine particle film is suitably from $1\times10^3$ to $1\times10^7$ Ω/s, and thus it is desirable to control the thickness of the fine particle film so that the film may have a resistance value in this range.

In the aforesaid explanation, one electron emitting element has been noticed, but many elements can be arranged in the state of a multi-arrangement as shown in FIG. 3. In this case, the pitches $P_1$ and $P_2$ of the electron emitting elements 24 depend upon the type of application, but in order to obtain a uniform and flat electron source, these pitches $P_1$ and $P_2$ beth are suitably within several mm, and in the case that they are applied to a flat CRT, it is necessary that the pitches $P_1$ and $P_2$ beth are in the range of 0.01 mm to 2 mm. The lengths 1 of the electron emitting elements 24 are suitably from 0.1 mm to 1.0 mm. For example, in the case of the flat CRT, the number of the elements to be arranged is from about several tens to about 1000 per line, and the number of the lines is from about 100 to about 1000.

In order to achieve the forming of the electron emitting portions 23 in the thus constituted multi-electron source, a conduction treatment is carried out which is a feature of the present invention. Next, this forming process will be described.

Figure 5:
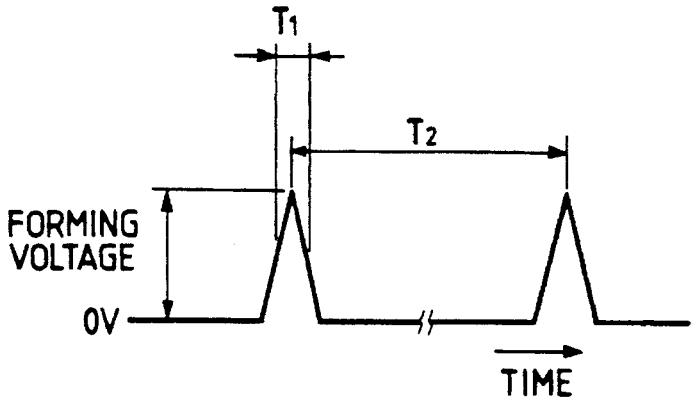
FIGS. 5 and 6 are views illustrating wave-forms of pulse voltage which can be used in the present invention.
Figure 6:
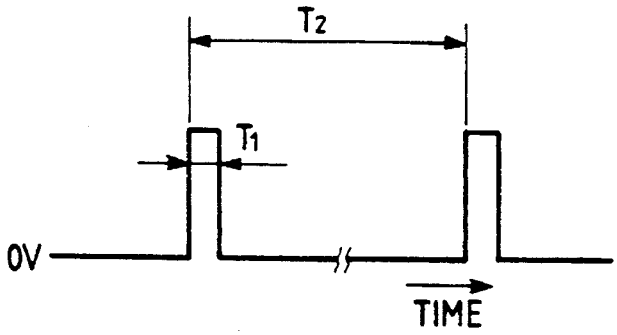

Pulse voltage is generated by means of a power source 26 for the forming which is connected as shown in FIG. 3. The pulse wave-form is suitably a triangle wave or a rectangular wave as shown in FIGS. 5 and 6, which is not restrictive. In FIGS. 5 and 6, $T_1$ is a pulse width and $T_2$ is a pulse interval. Suitably, the pulse width $T_1$ is from 1 μsec. to 1 sec., and the pulse interval $T_2$ is from 100 μsec. to 10 sec., which is not restrictive. According to intensive research by the present inventors, a suitable voltage is present for the effective conduction treatment, and it has been elucidated that when temperature rises, characteristics of the elements deteriorate. In short, it can be presumed that the electron emitting portions are not formed as a result of the rise of the temperature of the fine particle films and the modification thereof by allowing current to flow in the fine particle films, but properly formed by applying the voltage to the films so as to bring about the migration of atoms constituting the fine particles. That is, as the number and the density of the elements increase, the temperature of the fine particle films rises at the time of the conduction treatment, so that defects tend to occur. The pulse voltage is therefore suitably 20 V or less, and more suitably from 4 V to 10 V. In order to suppress the heat generated by the forming as much as possible, it is necessary to set the pulse width and the pulse interval to proper values. For example, when the pulse width $T_1$ is 100 μsec. and the pulse interval $T_2$ is 10 μsec., the consumption of electric power can be reduced to 1/100. The time required for the forming depends largely upon the material, quality and electrical resistance of the fine particle films. For example, in the case that the material of the fine particle films is gold, silver or palladium and $T_1$ is 100 μsec. and $T_2$ is 10 μsec., the time required for the forming is about 0.05 to about 10 seconds. However, in the case that the material of the fine particle films is $SnO_2$, a time of about 5 minutes to about 1000 minutes is needed. Furthermore, when the pulse width and the pulse interval are set to proper values, the forming can be achieved in an extremely uniform state without causing any temperature distribution during the forming.

Figure 1:
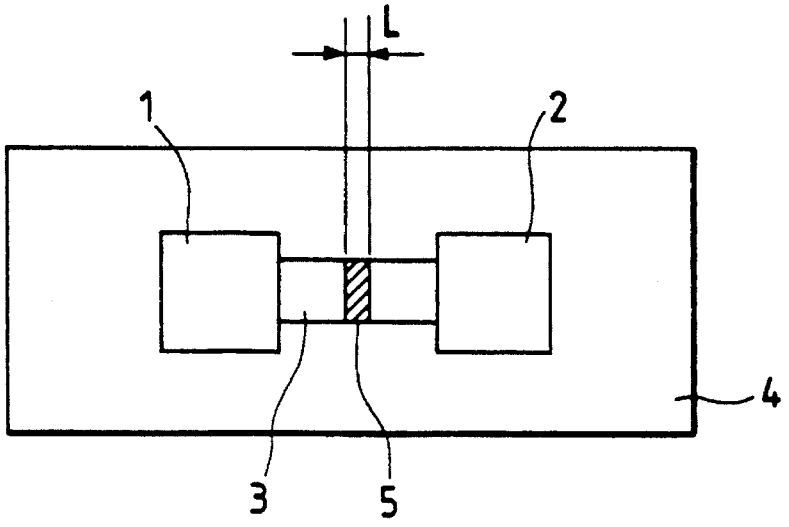
FIGS. 1 and 2 are constitutional views illustrating conventional surface conduction type electron emitting elements.
Figure 2:
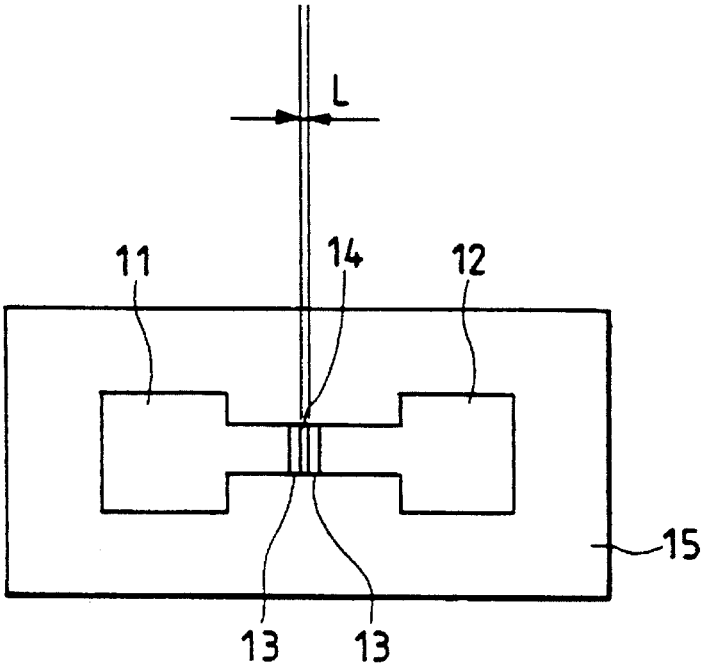

The forming of such a fine particle film as shown in FIG. 2 has been described above, but this technique can be applied to the forming of such a thin film as shown in FIG. 1.

That is, when the multi-electron source of the elements using the thin films is subjected to the conventional forming method, a large amount of heat is generated, and for this reason, it is extremely difficult to achieve the forming. Particularly, in the case of the multi-electron source having the small pitch $P_1$, it is impossible to prevent a large amount of heat from being generated. However, as disclosed in the present invention, the generation of the heat can be decreased by lowering the ratio of the pulse width $T_1$ to the pulse interval $T_2$, whereby the proper forming can be carried out. The present invention is particularly effective for the multi-electron source in which the element pitch is from 0.01 mm to 2.0 mm.

In addition, substantially all the electron emitting portions (crack portions) of the electron emitting elements of the multi-electron source prepared by the forming of the present invention have a width L in the range of 0.05 μm to 1.0 μm. As a result of intensive investigation, the present inventors have found that the width L of the electron emitting portions is closely concerned with the scatter of the electron emission quantity of the multi-electron source and the luminance scatter of fluorescent member. That As, it has been found that in the case that the width L of the electron emitting portion is An the range of 0.05 μm to 1.0 μm, preferably 0.1 μm to 0.5 μm, the scatter of the electron emission quantity of the multi-electron source and the luminance scatter of the fluorescent member are 15% or less (in the above-mentioned preferable range, they are 12% or less). In this connection, the widths L of the electron emitting portions can be attained by suitably controlling forming conditions of the present invention such as pulse voltage value, pulse width and pulse interval. It also has been found that in the case that the deviation of the average widths of electron emitting elements is in the range of 0% to 100%, preferably 0% to 50%, the scatter of the electron emission quantity of the multi-electron source and the luminance scatter of the fluorescent member are 15% or less (in the above-mentioned preferable range, they are 12% or less). 0n the other hand, with regard to the multi-electron source prepared by a conventional forming technique, the widths of the electron emitting portions are in the range of 1000 Å to 20 μm, and the scatter of the electron emission quantity of the multi-electron source and the luminance scatter of the fluorescent member extremely large. The average widths L of the electron emitting portions can be measured as follows: The electron emitting portion (numeral 5 in FIG. 1, and numeral 14 in FIG. 2 ) is equally divided into 10 portions, and these portions are observed by means of a scanning type electron microscope. Successively, the widths of the electron emitting portions are measured at these 10 points, and the average value of the values at these 10 points is regarded as the average width $L_1$ of the electron emitting portion. Further, the deviation (Δd) of average widths can be calculated by measuring the average widths can be calculated by measuring the average width $L_1$ for each of the plurality of electron emitting portions according to the above procedure, then obtaining the average value $L_2$ of the plural $L_1$ values and calculating the Δd value according to the following equation:

$$\Delta d=|L_2-L_1|/L_1\times 100$$

Since the electron emitting portion formed by the forming treatment in the present invention is often in the shape of an irregular crack, the above procedures for measurement of $L_1$, $L_2$ and Δd are partially useful.

Next, reference will be made to the scatter of the electron emission quantity of the multi-electron source and the luminance scatter of the fluorescent member in reference to an image forming device shown in FIG. 8 which is one embodiment of the present invention. The scatter of the electron emission quantity of the multi-electron source can be measured as follows: Suitable voltage is applied to the element wires 42 and the grid wires 43, and electron beams generated from the respective electron emitting elements 24 are allowed to collide against the fluorescent member. Then, current which flows in the fluorescent member (current which flows in an EV terminal) is measured. On the other hand, the luminance scatter of the fluorescent member can be measured by shooting the luminance of the fluorescent member with a CCD camera. In both the cases, the scatter is represented by standard deviation.

As described above, when the widths L of the electron emitting portions in the electron emitting elements are set to a value in the range of 0.05 μm to 1.0 μm, there can be obtained the multi-electron source having the less scatter of the electron emission quantity and the image forming device having the less luminance scatter of the fluorescent member.

Now, the present invention will be described in detail in reference to examples.

EXAMPLE 1

In this example, a plurality of elements using fine particle films as mentioned above (FIG. 2) were arranged as in FIG. 3 to prepare a multi-electron source. In this case, the length l of electron emitting portions was 200 μm, the electrode gap G was 2.5 μm, and the element pitch $P_1$ was 400 μm. The fine particle films were prepared by dispersing and applying organic palladium (CCP-4230, made by Okuno Seiyaku Co., Ltd.), and then heating it at 300° C. These fine particle films were films of ultrafine particles of palladium oxide, and the particle diameter of these particles were about 100 Å. The number of the elements was 100 per line, and the number of the arranged lines were 100.

These elements were subjected to the undermentioned forming, and electron emission properties were then measured. At the time of the forming, the pulse wave-form was a triangle wave.

Conditions for the forming were as follows.

(1) One example of the present invention

Pulse width $T_1$=500 μsec.

Pulse interval $T_2$=50 msec.

Forming voltage=6.5 V

Forming time=60 sec.

(2) Conventional example

Forming voltage=about 5 V (DC voltage)

Voltage rise rate=1 V/min.

In the case of the conventional forming employing the above-mentioned conditions (2), electrons were emitted from several elements of the 100 elements in one line. On the other hand, in the case of the forming employing the conditions (1) of the present invention, electrons were emitted substantially uniformly from all of the 100 elements. When driving voltage (voltage which was applied between wiring electrodes to emit electrons) was 15 V, the electron emission quantity per line was 20 μA under the conventional conditions (2), but it was 200 μA under the conditions (1) of the present invention. With regard to evaluation, uniformity was evaluated at points of fluorescent member on a face plate (not shown) disposed 5 mm above the plate electron source, and the emission current of electron beams was measured from the current which flowed in the fluorescent member.

Next, the above-mentioned conditions (1) were used and a rectangular wave shown in FIG. 6 was employed as the pulse wave-form, and thus, similar effects were obtained. In this example, the applicable forming voltage is in the range of 4 V to 10 V, and in this range, a substantially uniform electron emission quantity was obtained. When the forming voltage was in excess of 10 V, the electron emission quantity partially decreased with the rise of the voltage, so that ununiformity increased. When it was 20 V or more, the electron emission quantity noticeably decreased. On the other hand, when the forming voltage was less than 4 V, the forming was insufficient, so that the electron emission quantity decreased.

Furthermore, the proper driving voltage for these elements is in the range of 10 V to 18 V. However, when the forming of this example was carried out at this voltage, the electron emission could be obtained from all of the 100 elements per line, but it was observed that the electron emission partially deteriorated, which meant that the plate electron source was ununiformed. To sum up, it can be understood that the proper forming voltage is in the range of 4 V to 10 V.

Next, in this example, a forming voltage of 4 V to 10 V was applied for several seconds in the first step, and a forming voltage of 10 V to 18 V was then applied for several seconds in the second step. In this case, the electron source was prepared within 15 seconds in which the electron emission quantity was uniform and the electron emission did not deteriorate. To sum up, the forming time can be shortened by applying a voltage of 4 V to 10 V and then applying a pulse voltage of 10 V or more.

EXAMPLE 2

In this example, a plurality of elements using thin films as mentioned above (FIG. 1) were arranged as in FIG. 3 to prepare a multi-electron source. In this case, length l of electron emitting portions was 100 μm, the electrode gap G was 200 μm, and the element pitch $P_1$ was 2.0 mm. The thin films were prepared from gold so as to have a thickness of about 800 Å. The number of the elements was 100 per line, and the number of the arranged lines were 100.

These elements were subjected to the undermentioned forming, and electron emission properties were then measured. At the time of the forming, the pulse wave-form was a triangle wave. Conditions for the forming were as follows.

(1) One example of the present invention

Pulse width $T_1$=200 μsec.

Pulse interval $T_2$ =10 msec.

Forming voltage=8.0 V

Forming time=60 sec.

(2) Conventional example

Forming voltage=about 8 V (DC voltage)

Voltage rise rate=1 V/min.

With regard to the elements treated under conditions (2), electrons were emitted from 5 elements of the 100 elements in one line. On the other hand, in the case of the forming under conditions (1) regarding the present invention, electrons were emitted substantially uniformly from all of the 100 elements.

Next, a rectangular wave was employed as the pulse wave-form, and in this case, obtained effects were similar to those of the case where the triangle wave was used.

In addition, with regard to the voltage and the pulse duration of the pulse forming, investigation was made in the same manner as in Example 1. As a result, substantially similar effects could be obtained.

Moreover, for the elements treated under the conditions (2), the cause of properties deterioration was inspected. As a result, it was found that heat generated at the time of the forming was one cause of the breakage of the substrate and the electrodes.

EXAMPLE 3

Figure 7:
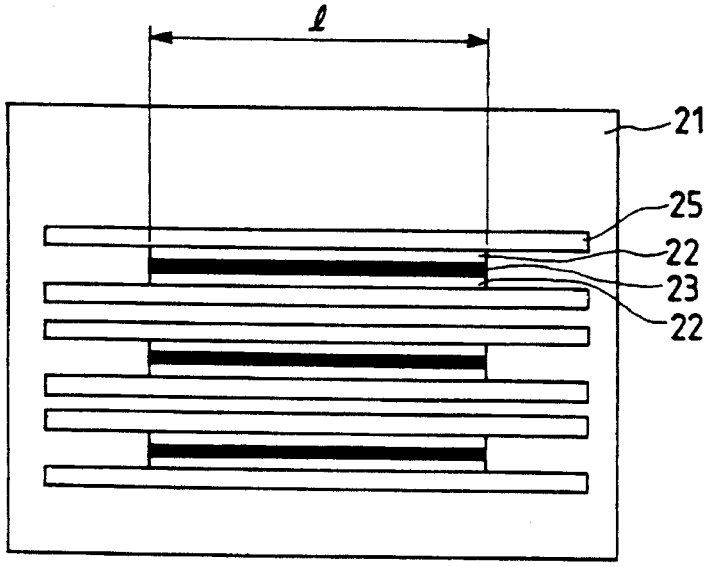
FIG. 7 is a constitutional view of a multi-electron source regarding the third embodiment of the present invention.

FIG. 7 shows the third example of the present invention. This example was concerned with a linear electron source in which the element pitch $P_1$ mentioned in Example 1 was zero and the number of the lines was 50. In this case, the length l of each element was 20 mm, and the other conditions were about the same as in Example 1. In this example, the pulse width $T_1$ was fixed at 100 μsec., and the pulse interval $T_2$ was changed. The results are shown in Table 1.

TABLE 1

| $T_2$ | 200 μsec–2 msec | 2 msec–5 msec | 5 msec or more |
|---|---|---|---|
| Uniformity | B | A | AA |
| Quantity of Emitted Electrons | less than 40 μA | 40–200 μA | more than 200 μA |
| Consumed Electric Power at Forming | large | medial | small |

B: practically acceptable
A: good
AA: excellent

As understood from these results in Table 1, when the pulse interval $T_2$ was prolonged so as to decrease the consumption of electric power at the time of the forming and so as to prevent the temperature of the electron source from rising, the electron source having uniform and good electron emission properties could be obtained.

On the other hand, when the pulse width $T_1$ was changed in this example, the good electron emission properties could be obtained at a pulse width $T_1$ of 10 seconds or less.

EXAMPLE 4

Figure 8:
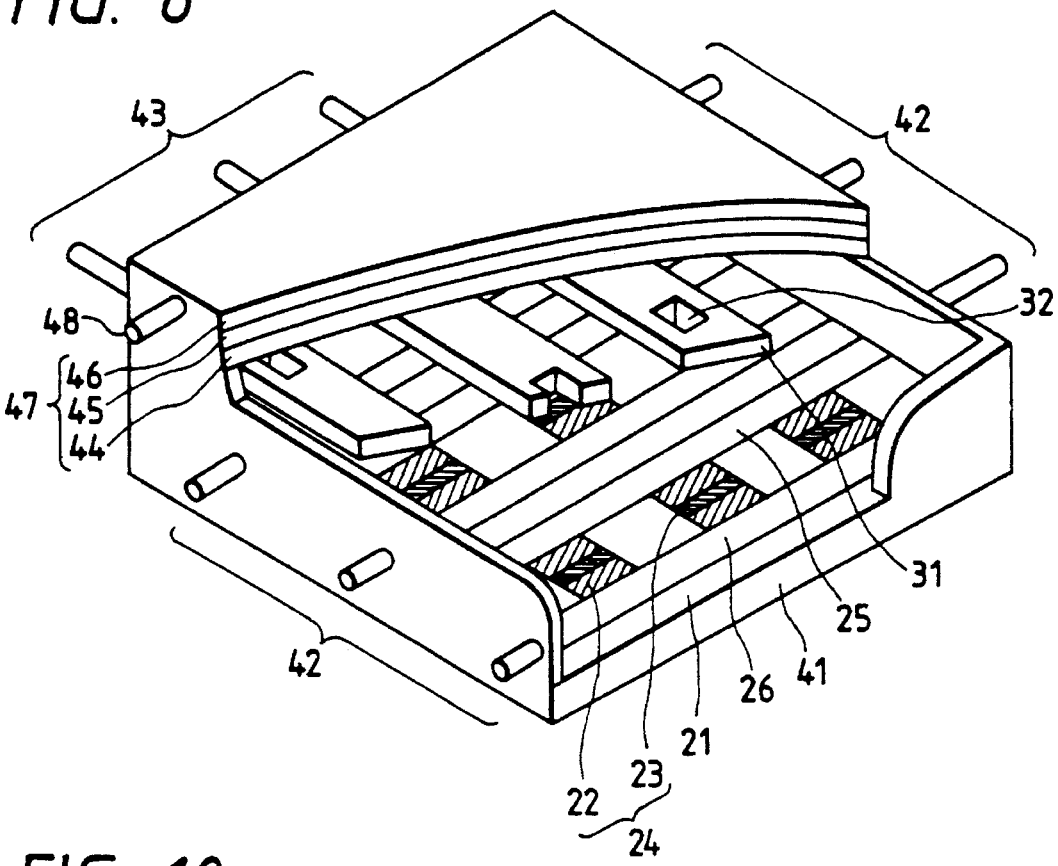
FIG. 8 is a schematic constitutional view illustrating an image forming device of the present invention.

An image-forming device shown in FIG. 8 was prepared by the use of a multi-electron source in Example 1. In this drawing, reference numeral 47 is a face plate, numeral 46 is a glass plate, 44 is a transparent electrode and 45 is a fluorescent member. A space between the face plate 47 and a rear plate 41 was 3 millimeters.

The above-mentioned image-forming device was driven by the following procedure. The vacuum degree in the panel container comprising the face plate 47 and the rear plate 41 was adjusted to $10^{-6}$ torr, and the voltage in the surface of the fluorescent member was set to 5 to 10 KV through an EV terminal 48. A driving voltage of 14 V was first applied between a pair of wiring electrodes 25, 26 via wires 42. Next, a voltage corresponding to an information signal was applied to a modulation means via wires 43 to control the ON-OFF of emitted electron beams. In this case, the OFF control of the electron beams could be achieved by a voltage of −30 V or lower, and the ON control thereof could be done by a voltage of 0 V or higher. Furthermore, the electron quantity of the electron beams could be continuously changed between −30 V and +0 V, and the display of gradation was possible.

The electron beams corresponding to the information signal emitted through the modulation means collide against the fluorescent member 45, and at this time, these fluorescent member 45 displayed one line in reply to the information signal. This operation was repeated for the subsequent lines of electron emitting elements in turn to display one image.

The image displayed by the image-forming device in this example was a clear image having a less luminance scatter and a high contrast. Furthermore, also on an image-forming device equipped with a face plate of a usually well-known cathode ray tube type using color fluorescent materials of R (red), G (green) and B (blue) as the fluorescent member 45, a uniform image having no display defect could be displayed.

In this example, the width of the electron emitting portions and the luminance scatter of the fluorescent member were measured, and the obtained results were as follows.

| Forming Condition | Condition (1) (Present Invention) | Same as Left Except Forming Voltage 12V | Same as Left Except Forming Voltage 18V | Condition (2) (Conventional Method) |
|---|---|---|---|---|
| Average Widths of Electron Emitting Portions $L_1$ | 500Å–5000Å | 1500Å–10000Å | 1500Å–14000Å | Elements with 1 μm or more were present. |
| Deviation Δd | ≦50% | ≦70% | ≦100% | ≧200% |
| Luminance Scatter of Fluorescent Member | 10% AA | 15% AA–A | 25% A | B |
| Current Scatter of Electron Emitting Elements | 10% AA | 15% AA–A | 25% A | B |

B: practically acceptable
A: good
AA: excellent

As is apparent from the results in this example, the multi-electron source and the image-forming device in which the width of the electron emitting portions was from 500 Å to 10,000 Å had more excellent uniformity as compared with a conventional one.

EXAMPLE 5

Figure 9:
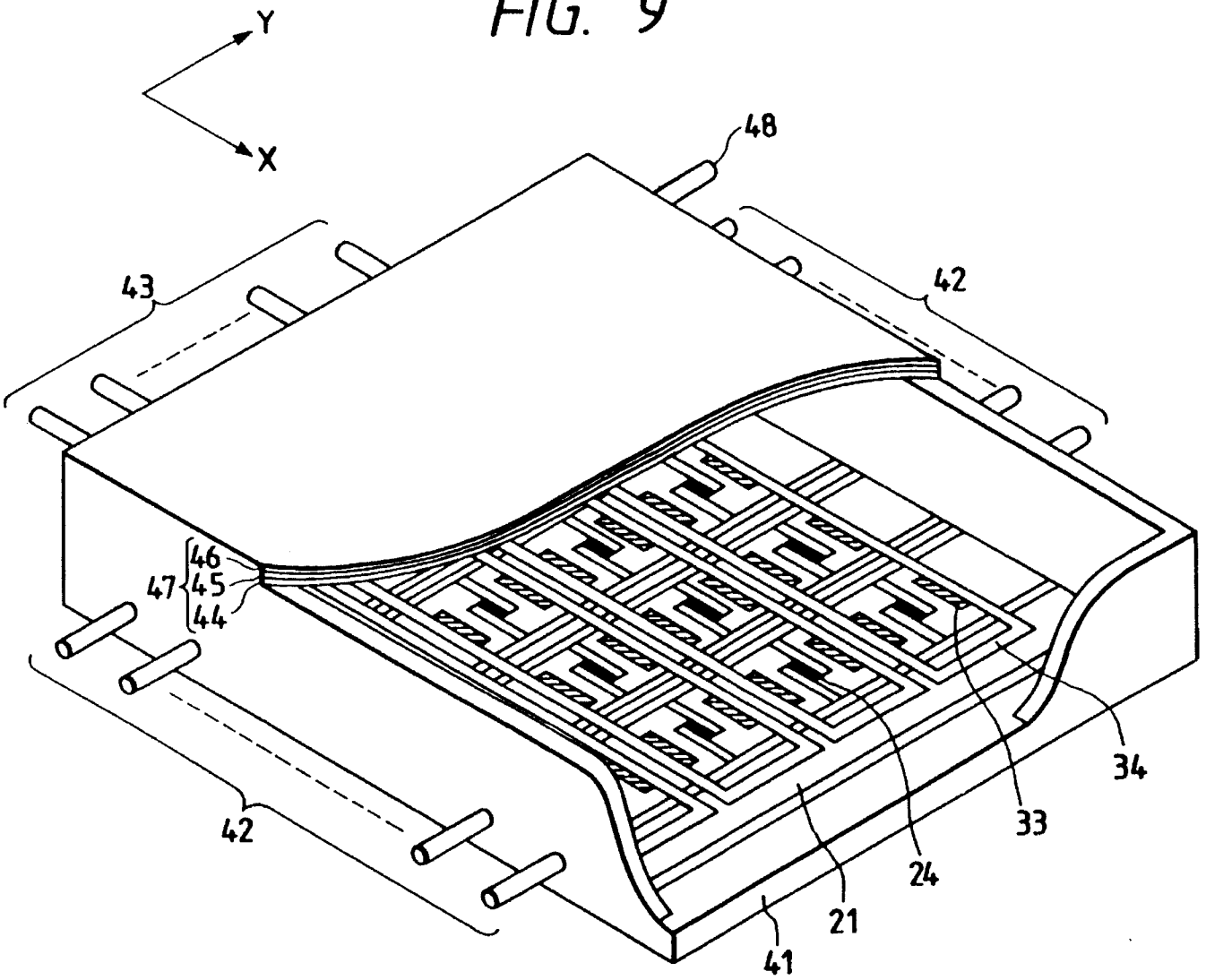
FIG. 9 is a schematic constitutional view illustrating another image forming device of the present invention.

An image-forming device shown in FIG. 9 was prepared by the use of a multi-electron source of Example 1. The image-forming device in this example had the same structure as the image-forming device of Example 4 except that grid electrodes were formed integrally with electron emitting elements on an insulating substrate. In FIG. 9, numeral 33 is a grid electrode, and 34 is a wire of grid electrodes.

Operation was carried out by the same procedure as in Example 4 to display a luminous image of fluorescent member. However, the OFF control of electron beams was carried out by applying a voltage of −40 V or lower to a modulation means, and the ON control of the electron beams was carried out by applying a voltage of +10 V or higher. Furthermore, the electron quantity of the electron beams could be continuously changed between −40 V and +10 V, and display of gradation was also possible.

Also in this example, the same effects as in Example 4 could be confirmed.

EXAMPLE 6

Figure 10:
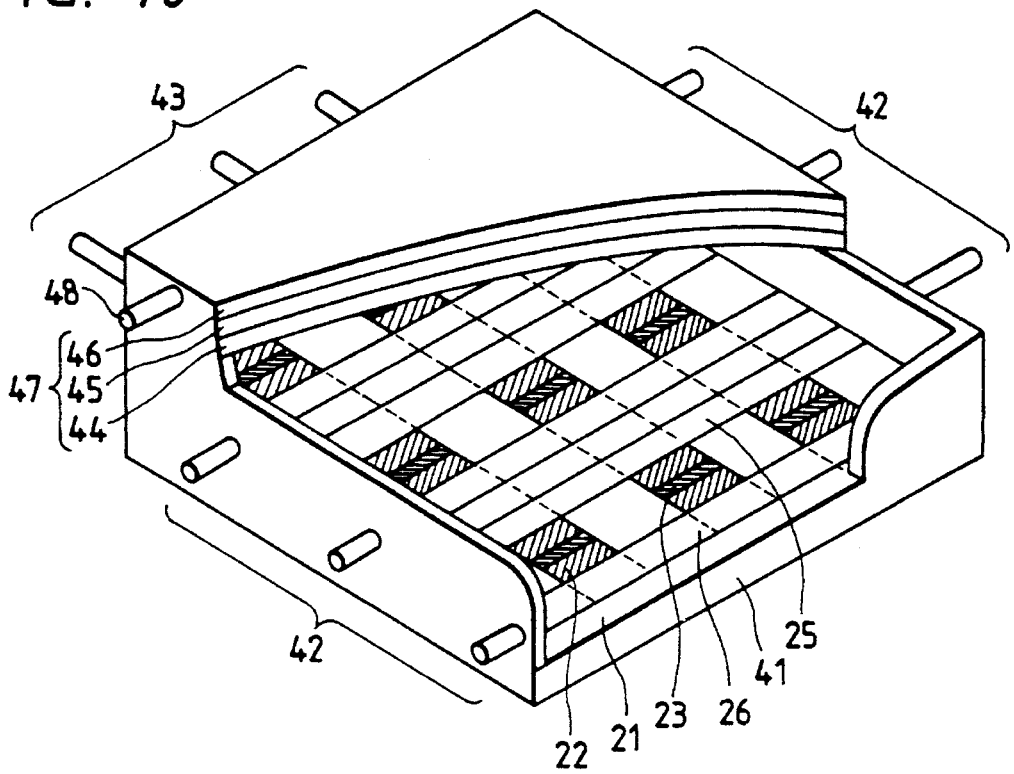
FIG. 10 is a schematic constitutional view illustrating still another image forming device of the present invention.
Figure 11:
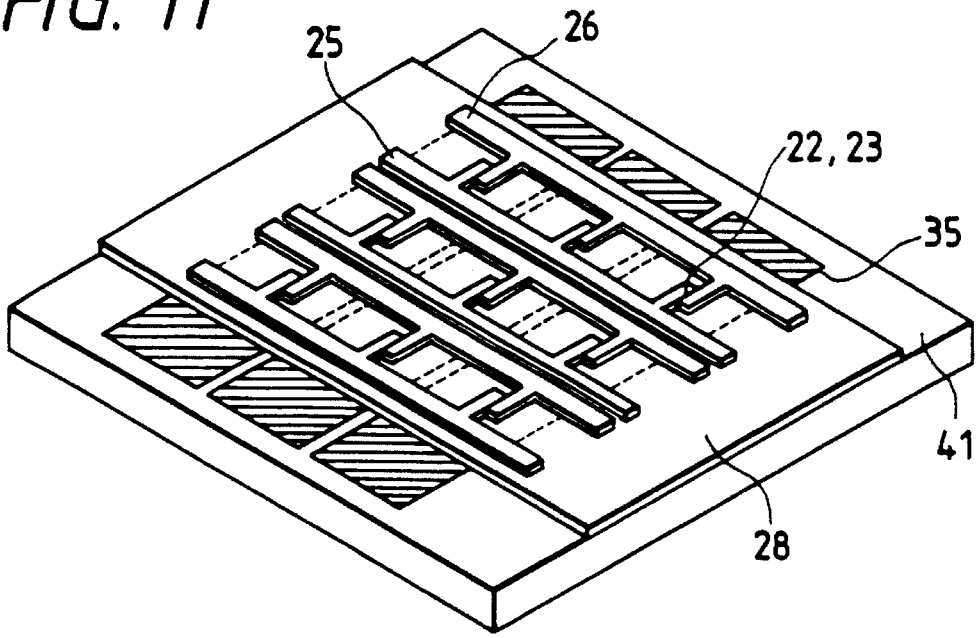
FIG. 11 is a schematic constitutional view illustrating an electron emitting device comprising the multi-electron source and grid electrodes of FIG. 10.

An image-forming device shown in FIG. 10 was prepared by the use of a multi-electron source of Example 1. FIG. 11 is a constitutional view illustrating a multi-electron source and grid electrodes of this example. The image-forming device of this example had the same structure as the image-forming device of Example 4 except that grid electrodes were formed on the back surfaces of elements via an insulating film 28. In FIGS. 10 and 11, numeral 35 is a modulation electrode, and 27 is an insulating film.

Operation was carried out by the same procedure as in Example 4 to display a luminous image of fluorescent member. However, the OFF control of electron beams was carried out by applying a voltage of −40 V or lower to a modulation means, and the ON control of the electron beams was carried out by applying a voltage of +10 V or higher. Furthermore, the electron quantity of the electron beams could be continuously changed between −40 V and +10 V, and the display of gradation was also possible.

Also in this example, the same effects as in Example 4 could be confirmed.

EXAMPLE 7

Figure 12:
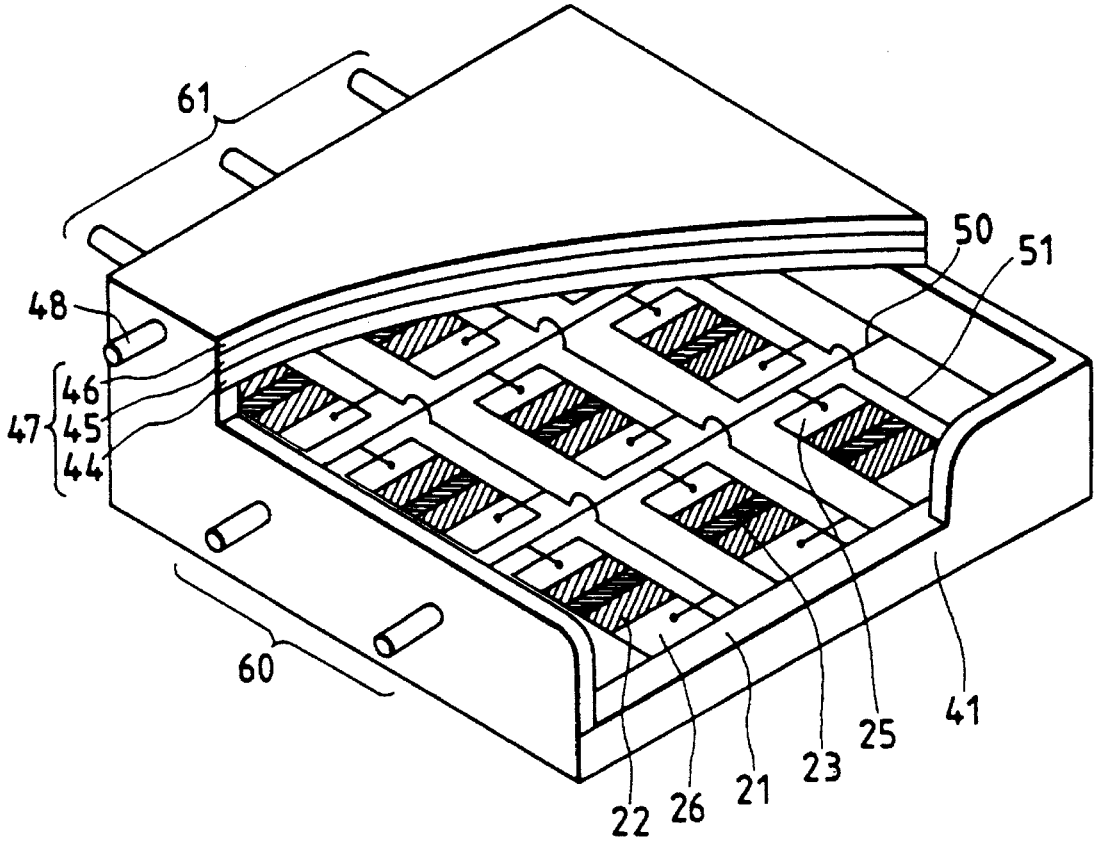
FIG. 12 is a schematic constitutional view illustrating still another image forming device of the present invention.

An image-forming device of this example is shown in FIG. 12. This example is concerned with a multi-electron source having a simple matrix structure in which a plurality of electron emitting elements are arranged in lines and columns and connected to signal wiring electrodes 51 and scanning wiring electrodes 50. In FIG. 12, numerals 60 and 61 are wires connected to the scanning wiring electrodes 50 and the signal wiring electrodes 51 respectively.

Next, a conduction treatment in this example was carried out by applying the same pulse voltage as in Example 1 between the wires 60 and 61.

The image-forming device of this example was driven by the following procedure.

A vacuum degree in a panel container comprising a face plate 47 and a rear plate 41 was adjusted to $10^{-6}$ torr, and the voltage of the surface of the fluorescent member was set to 5–10 KV through an EV terminal 48. The emission of electron beams from the electron emitting elements could be achieved by applying an element voltage to each of the electron emitting elements. That is, a pulse voltage of 0 V or a half of the element voltage was first applied to the plurality of electron emitting elements in one line through the scanning wiring electrode 50, and a pulse voltage of 0 V or a half of the element voltage was then applied to the signal wiring electrode 51 in response to an information signal, so that electron beams corresponding to the information signal collide against a fluorescent member 45. As a result, the fluorescent member 45 displayed one line corresponding to the information signal. This operation was repeated in the subsequent lines in turn to display one image. Also in this example, the same effects as in Example 4 were confirmed.

As described above, according to the present invention, pulse voltage is used as voltage to be applied for the sake of the formation of electron emitting portions by a conduction treatment, and thus, (1) a multi-electron source having uniform characteristics can be prepared, (2) a high resolution (fine pitch) multi-electron source can be prepared, and (3) a multi-electron source having less property degradation can be prepared.

Furthermore, according to the present invention, the width of the electron emitting portions can be adjusted in the range of 500 Å to 10,000 Å, and thus, (4) an image-forming device of the present invention using the multi-electron source can provide a uniform display image having a less luminance scatter and less defects, and (5) a uniform multi-electron source can be obtained in which the scatter of electron beam quantity emitted from the respective electron emitting elements is reduced.

What is claimed is:

1. A multi-electron source having a plurality of electron emitting elements arranged on a substrate and electrically connected to each other, each of said electron emitting elements comprising a conductive film containing a crack as an electron emitting portion, wherein, an average width of the cracks of all the electron emitting elements is in the range of 0.05 μm to 1.0 μm.

2. The multi-electron source according to claim 1, wherein the average width of said crack is in the range of 0.1 μm to 0.5 μm.

3. The multi-electron source according to claim 1, wherein said conductive film is a film of fine particles.

4. The multi-electron source according to claim 3, wherein the average particle diameter of said fine particles is in the range of 10 Å to 0.5 μm.

5. The multi-electron source according to claim 1, wherein the pitch of said electron emitting portions is in the range of 0.01 mm to 2 mm.

6. An electron emitting device comprising a multi-electron source as defined in any of claims 1 to 5, and a modulation means for modulating a plurality of electron beams emitted from said plurality of electron emitting portions in accordance with an information signal.

7. An image forming device comprising a multi-electron source as defined in any of claims 1 to 5, a modulation means for modulating a plurality of electron beams emitted from said plurality of electron emitting portions in accordance with an information signal, and an image forming member for forming an image by irradiation with the electron beams.

8. A multi-electron source having a plurality of electron emitting elements arranged on a substrate and electrically connected to each other, each of said electron emitting elements comprising a conductive film containing a crack as an electron emitting portion, wherein a deviation of average widths of the cracks of all the electron emitting elements is in a range of 0% to 100%.

9. The multi-electron source according to claim 8, wherein said deviation of average widths of cracks is in the range of 0 to 50%.

10. The multi-electron source according to claim 8, wherein said conductive films are films of fine particles.

11. The multi-electron source according to claim 8, wherein the average particle diameter of said fine particles is in the range of 10 Å to 0.5 μm.

12. The multi-electron source according to claim 8, wherein the pitch of said electron emitting portions is in the range of 0.01 mm to 2 μm.

13. An electron emitting device comprising a multi-electron source as defined in any of claims 8 to 12, and a modulation means for modulating a plurality of electron beams emitted from said plurality of electron emitting portions in accordance with an information signal.

14. An image forming device comprising a multi-electron source as defined in any of claims 8 to 12, a modulation means for modulating a plurality of electron beams emitted from said plurality of electron emitting portions in accordance with an information signal, and an image forming member for forming an image by irradiation with the electron beams.

* * * * *

UNITED STATES PATENT AND TRADEMARK OFFICE

CERTIFICATE OF CORRECTION

PATENT NO. : 5,578,897

DATED : November 26, 1996

INVENTORS : ICHIRO NOMURA ET AL.

It is certified that error appears in the above-identified patent and that said Letters Patent is hereby corrected as shown below:

Column 2 line 39, "end" should read --and--;
line 49, "end" should read --and--;
line 56, "end" should read --and--;
line 58, "end" should read --and--.

Column 3 line 10, "significantly" should read --significant,--;
line 12, "ununiformed" should read --nonuniform--;
line 17, "are" should read --is--;
line 22, "the" should read --a--;
line 25, "image forming" should read --image-forming--;
line 53, "That is, an object Of" should read --An object of--.

Column 5 line 52, "dispersing-and" should read --dispersing and--;
line 62, "noticed," should read --dicussed--.

Column 6 line 2, "beth" should read --both--;
line 36, "μsec.," should read --msec.,--;

UNITED STATES PATENT AND TRADEMARK OFFICE

CERTIFICATE OF CORRECTION

PATENT NO. : 5,578,897

DATED : November 26, 1996

INVENTORS : ICHIRO NOMURA ET AL.

It is certified that error appears in the above-identified patent and that said Letters Patent is hereby corrected as shown below:

Column 6 line 42, "μsec.," should read --msec.,--.

Column 7 line 8, "of" should read --of, the-- and "As," should read --is,--;
line 10, "An" should read --in--;
line 23, "0n" should read --On--;
line 29, "extremely" should read --are extremely--;
line 32, "2 )" should read --2)--;
line 39, Delete "widths can be calculated by";
line 40, Delete "measuring the average".

Column 8 line 22, "were" should read --was--;
line 24, "were" should read --was--;
line 50, "of" should read --of the--.

Column 9 line 7, "ununiformed" should read --nonuniform--;
line 28, "were" should read --was--.

UNITED STATES PATENT AND TRADEMARK OFFICE

CERTIFICATE OF CORRECTION

PATENT NO. : 5,578,897

DATED : November 26, 1996

INVENTORS : ICHIRO NOMURA ET AL.

It is certified that error appears in the above-identified patent and that said Letters Patent is hereby corrected as shown below:

Column 10 line 54, "these" should read --the--;
line 61, Delete "a" (2nd occurence);
line 40, "of" should read --of the--;
line 12, Delete "a" and "less" should read --fewer--.

Signed and Sealed this

Fourth Day of November, 1997

*Attest:*

*Attesting Officer*

Bruce Lehman

BRUCE LEHMAN

*Commissioner of Patents and Trademarks*